US008830014B2

(12) United States Patent
Surinder et al.

(10) Patent No.: US 8,830,014 B2
(45) Date of Patent: Sep. 9, 2014

(54) FILTER UTILIZING COMBINATION OF TE AND MODIFIED HE MODE DIELECTRIC RESONATORS

(75) Inventors: Singh Surinder, Ahmedabad (IN); Soni Shilpi, Ahmedabad (IN)

(73) Assignee: Indian Space Research Organization, Bangalore (IN)

( * ) Notice: Subject to any disclaimer, the term of this patent is extended or adjusted under 35 U.S.C. 154(b) by 450 days.

(21) Appl. No.: 13/138,312

(22) PCT Filed: Mar. 31, 2009

(86) PCT No.: PCT/IN2009/000219

§ 371 (c)(1),
(2), (4) Date: Oct. 11, 2011

(87) PCT Pub. No.: WO2010/086869

PCT Pub. Date: Aug. 5, 2010

(65) Prior Publication Data

US 2012/0019339 A1 Jan. 26, 2012

(30) Foreign Application Priority Data

Feb. 2, 2009 (IN) ..... 228/CHE/2009

(51) Int. Cl.
*H01P 1/20* (2006.01)
*H01P 1/208* (2006.01)

(52) U.S. Cl.
CPC ..... *H01P 1/2084* (2013.01)
USPC ..... 333/202; 333/219.1

(58) Field of Classification Search
CPC ..... H01P 1/2084
USPC ..... 333/202, 219.1
See application file for complete search history.

(56) References Cited

U.S. PATENT DOCUMENTS 4,652,843 A 3/1987 Tang et al.
6,707,353 B1 * 3/2004 Yamakawa et al. ..... 333/202

FOREIGN PATENT DOCUMENTS

JP 60-145701 8/1985
JP 2003-152401 5/2003

OTHER PUBLICATIONS

Weily, A.R., et al.; "Dielectric Resonators;" *In: Encyclopedia of RF and Microwave Engineering*; vol. 6, edited by Chang K. ISBN 0-471-27053-9, pp. 999-1014 (2005).

* cited by examiner

*Primary Examiner* — Benny Lee
(74) *Attorney, Agent, or Firm* — D. Peter Hochberg; Sean F. Mellino; Richard A. Wolf

(57) ABSTRACT

A dielectric resonator filter comprising a metal wall that is configured with metal cavities. Dielectric resonators can be placed in the metal cavities and configured as a set of cylindrical TE mode resonators and a set of rectangular HE mode resonators. Separating walls are disposed between the dielectric resonators, which include tunable irises for electromagnetic mixed coupling between the cylindrical TE mode resonators and the rectangular HE mode resonators. The rectangular HE mode resonators are configured to shift up the TE mode in frequency. This leads to an easy separation of two degenerate HE modes, a wide spurious free stop band and also achieves electric coupling without using any additional coupling member.

8 Claims, 2 Drawing Sheets

FILTER UTILIZING COMBINATION OF TE AND MODIFIED HE MODE DIELECTRIC RESONATORS

CROSS-REFERENCE TO RELATED APPLICATIONS

This application is a National Stage application of International Application No. PCT/1N2009/000219, filed on Mar. 31, 2009, which claims priority of Indian patent application number 228/CHE/2009, filed on Feb. 2, 2009, both of which are incorporated herein by reference in their entireties.

BACKGROUND OF THE INVENTION

1. Field of the Invention

The present invention relates to the field of dielectric resonator filters in mobile and satellite commutations. The present invention specifically relates to filters utilizing a combination of TE and modified HE mode dielectric resonators.

2. Description of the Prior Art

Dielectric resonator filters play an important role in mobile and satellite communications. Two types of dielectric resonator filters are commonly used. One type is a dual mode dielectric resonator filter, which operates in a HE 11 mode and provides low loss, smaller volume and elliptic function realizations. The inferior spurious characteristics in the output are the drawback of this type of dual mode dielectric resonator filter. The other type is a single mode dielectric resonator loaded filter with all resonators operating in a TE 01 mode, which provides low loss and good spurious free performance. In order to get the elliptic function characteristics in these types of filters, electric coupling between non-adjacent resonators is needed.

In dielectric resonator filters, the dominant coupling between dielectric resonators is magnetic in nature, which can be coupled between dielectric resonators (DR) using easily tunable irises. In the case of elliptic filters, there is a need to couple the electric field between non-adjacent dielectric resonators, which in the conventional approach needs some additional metallic member between the dielectric resonators. In the prior art, the electric field coupling between dielectric resonator pucks are achieved through a ground isolated coaxial probe method and a bar coupling method.

FIG. 1 shows a ground isolated probe method, which is the most commonly used method for realization of the electric field coupling between TE mode dielectric resonator pucks 2 and 4, which are separated by a metal separating wall 3. In this method, a metal probe 7 is placed in a suitable manner near the dielectric resonator pucks 2 and 4 to be coupled. The metal probe 7 is mounted between the metal cavities 1 and 5 by a conventional process as would be understood by one skilled in the art. This metal probe 7 is isolated from the metal cavities 1 and 5 by a suitable dielectric material 6, such as polytetrafluoroethylene (PTFE), e.g, TEFLON®. The probe dimensions become smaller with an increase in frequency and the probe fabrication, as well as the assembly becomes increasingly difficult. Thus, the metal probe 7 is an additional component. Moreover, the assembled probe coupling cannot be tuned and some other components and processes have to be employed for fine-tuning the required coupling. The metal probe 7 is normally placed very close to the dielectric resonator pucks 2 and 4, and hence limits the designs from spurious modes and high power point of view.

FIG. 2 shows a bar coupling method for realization of the electric field coupling between TE mode dielectric resonator pucks 22 and 24 in respective cavities 21 and 25. The coupling bar 26 made from a nickel-iron alloy material such as FeNi36 (64FeNi in the US) (e.g., INVAR®) is normally required for applications requiring operation over a large temperature range. This bar coupling can solve the tuning problem to some extent, but this is still an additional component required for the desired coupling. For low coupling values, the gaps between the wall 23 and the coupling bar 26 is low, which restricts suitable modification in the coupling arrangement for high power applications. Further, the filters utilize mixed mode electric couplings to use two HE mode resonators 35 and 36. Coupling between TE mode resonators 32 and 34 i.e. TE-TE coupling as well as TE-HE coupling is a positive coupling where as HE-HE coupling is a negative coupling. In a conventional mixed mode coupling, an Iris 37 is used between the HE mode resonators 35 and 36 for negative coupling in the same manner as is used for positive coupling between two TE mode resonators 32 and 34, as shown in FIG. 3. Hence, the negative coupling is also fully tunable in this method. However, there are many problems associated with this conventional implementation of the mixed mode coupling. In particular, the HE dielectric resonators 35 and 36 have two degenerate modes at the same frequency and are exploited well for dual mode dielectric resonator (DR) filters, but it is very difficult to separate in the single mode filters. Moreover, the size and weight of HE mode dielectric resonators 35 and 36 is high as compared to the TE mode dielectric resonators 32 and 34. Also shown in FIG. 3 are a metal wall 31 configured for defining metal cavities and separating walls 33 disposed between the resonators 32, 34, 35 and 36.

With respect to the conventional approaches, additional circuit components are utilized for realization of the electric field coupling between TE mode dielectric resonator pucks. However, in mixed mode electric couplings, these approaches result in an increase in the size and weight of the HE mode dielectric resonators. It is very difficult to separate the two degenerate modes of the resonators. Therefore, it is essential to provide an electrical field coupling between a pair of non-adjacent dielectric resonators operating in a single mode filter without using any additional component.

SUMMARY OF THE PRESENT INVENTION

Object of the Invention

An object of the present invention is to provide a dielectric resonator filter, which achieves an electrical field coupling between a pair of non-adjacent dielectric resonators operating in a single mode filter without using any additional coupling member.

Another object of the present invention is to provide a dielectric resonator filter, which enables easy separation of two degenerate HE modes that results in a wide spurious free performance.

Yet another object of the present invention is to provide a dielectric resonator filter, which reduces the size and weight of HE dielectric resonator.

According to one aspect, the present invention, which achieves the objectives, relates to a dielectric resonator filter comprising a metal wall configured for defining metal cavities. Dielectric resonators can be placed in the metal cavities and configured as a set of cylindrical TE mode resonators and a set of rectangular HE mode resonators. Separating walls are disposed between the dielectric resonators, which include tunable irises for electromagnetic mixed coupling between the cylindrical TE mode resonators and the rectangular HE mode resonators. The rectangular HE mode resonators are configured to shift up the TE mode in frequency along with the undesired orthogonal HE mode. This leads to an easy separation of two degenerate HE modes and also achieves a wide spurious free electric coupling without using any additional coupling member.

BRIEF DESCRIPTION OF THE DRAWINGS

The invention will be discussed in greater detail with reference to the accompanying Figures.

DETAILED DESCRIPTION OF THE INVENTION

Figure 1:
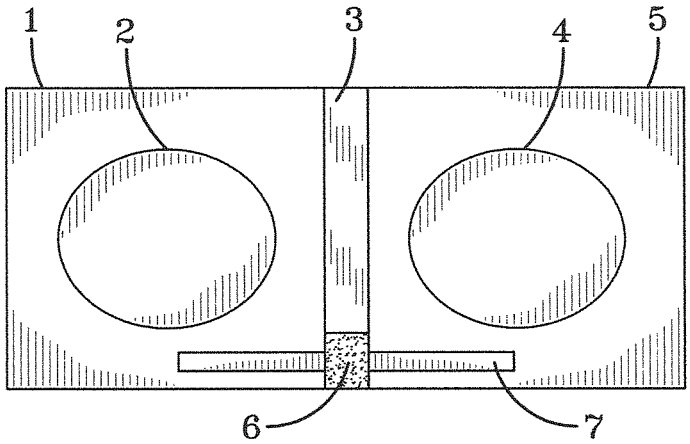
FIG-1 PRIOR ART
FIG. 1 shows aground isolated probe used for coupling two cylindrical dielectric resonator pucks, in accordance with a prior art.
Figure 2:
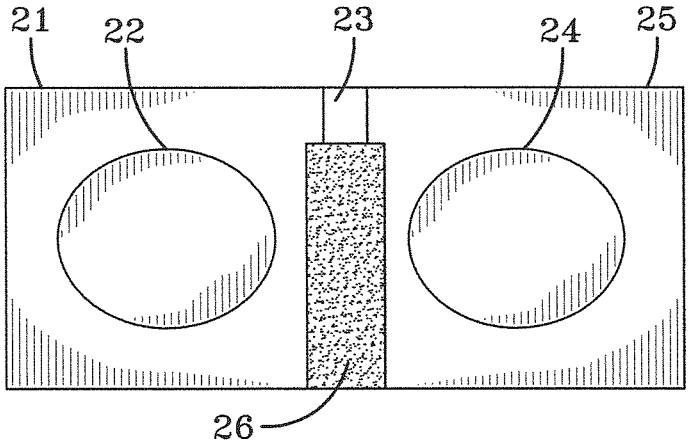
FIG-2 PRIOR ART
FIG. 2 illustrates a metallic bar for coupling an electric field between dielectric resonator pucks, in accordance with a prior art.
Figure 3:
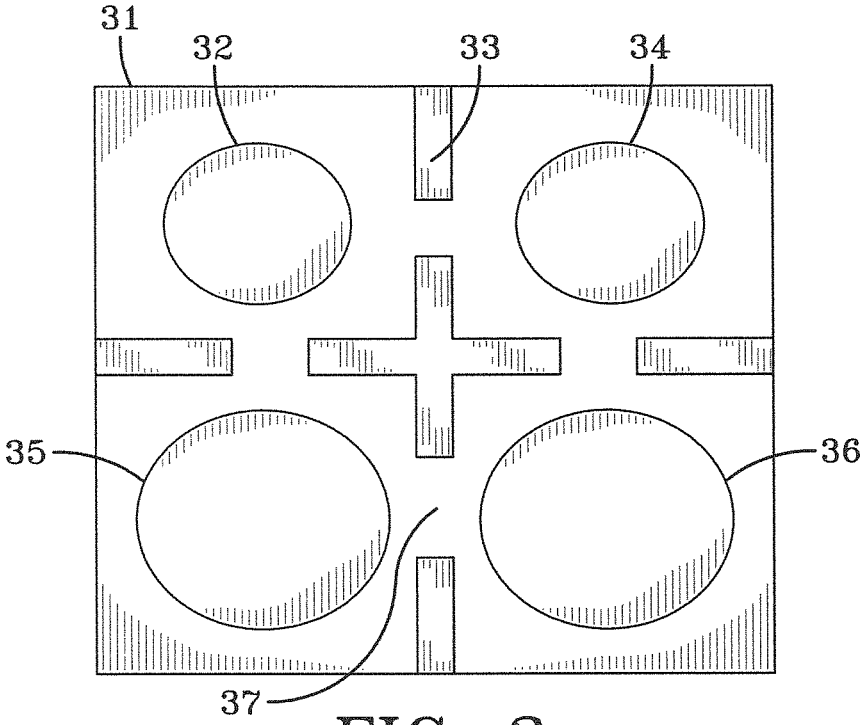
FIG-3 PRIOR ART
FIG. 3 illustrates a conventional mixed mode coupling between cylindrical dielectric resonator pucks, in accordance with a prior art.
Figure 4:
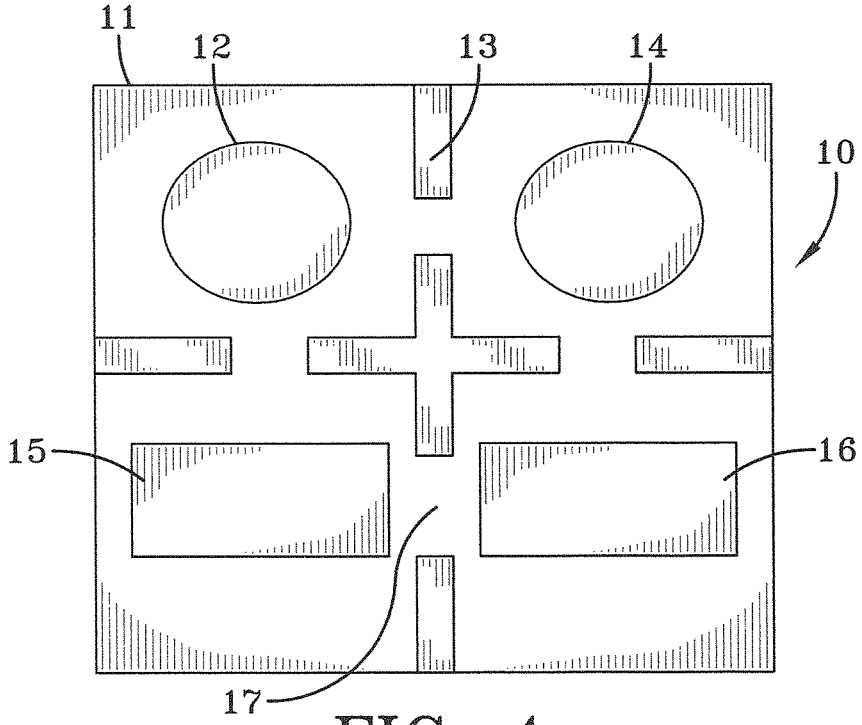
FIG. 4 illustrates a dielectric resonator filter with mixed mode couplings between cylindrical dielectric resonator pucks and rectangular dielectric resonator pucks, in accordance with an exemplary embodiment of the present invention.

Referring to FIG. 4, a dielectric resonator filter with mixed mode couplings between cylindrical dielectric resonators 12 and 14 and rectangular dielectric resonators 15 and 16, in accordance with an exemplary embodiment of the present invention is provided and referred to generally at numeral 10. The dielectric resonator filter is a single mode filter that utilizes mixed couplings between the dielectric resonators 12, 14, 15 and 16, where the dielectric resonators are configured as the cylindrical TE mode resonators 12 and 14 and the rectangular HE mode resonators 15 and 16.

Moreover, the dielectric resonator filter comprises a metal wall 11 configured for defining metal cavities. The dielectric resonators 12, 14, 15 and 16 can be placed in the metal cavities. Separating walls 13 are disposed between the dielectric resonators 12, 14, 15 and 16, which include tunable irises 17 for electromagnetic mixed coupling between the cylindrical TE mode resonators 12 and 14 and the rectangular HE mode resonators 15 and 16. Therefore, HE-HE coupling through the tunable irises 17 is used for realizing the electric coupling.

The rectangular shape of the HE mode resonators 15 and 16 is optimized in such a manner that the frequency of the required HE mode is not affected much whereas the unwanted orthogonal HE mode is shifted up. The TE mode is also shifted up in frequency in the rectangular HE mode dielectric resonators 15 and 16. By using the rectangular HE dielectric mode resonators 15 and 16, the TE mode is no longer on the lower side and moves higher along with the undesired orthogonal HE mode. Thus, this leads to an easy separation of the two degenerate HE modes and provides a wide spurious free range for the filters without using any additional coupling member. Such large spurious free performance of the filter is suitable for a high performance filter application. Additionally, the size and weight of this rectangular HE mode dielectric resonator 15 and 16 is less than the conventional cylindrical HE dielectric resonators.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

We claim:

1. A dielectric resonator filter with a combination of TE and HE modes, wherein the HE mode comprises a required HE mode and an undesired orthogonal HE mode, said dielectric resonator filter comprising:

a metal wall for defining a plurality of metal cavities;

a plurality of dielectric resonators placed in said plurality of metal cavities, wherein said plurality of dielectric resonators comprise a set of cylindrical TE mode resonators and a set of rectangular HE mode resonators; and one or more separating walls disposed between said plurality of dielectric resonators, wherein said one or more separating walls comprise a plurality of tunable irises for electromagnetic mixed coupling between said set of cylindrical TE mode resonators and said set of rectangular HE mode resonators.

2. The filter according to claim 1, wherein said plurality of tunable irises realize an electrical field coupling between said set of rectangular HE mode resonators.

3. The filter according to claim 1, wherein said set of rectangular HE mode resonators shifts the TE mode in frequency along with the undesired orthogonal HE mode.

4. The filter according to claim 1, wherein the rectangular shape of said set of rectangular HE mode resonators does not affect the frequency of the required HE mode and shifts the unwanted orthogonal HE mode.

5. A dielectric resonator filter with a combination of TE and HE modes, wherein the HE mode comprises a required HE mode and an undesired orthogonal HE mode, said dielectric resonator filter comprising:

a metal wall for defining a plurality of metal cavities;

a plurality of dielectric resonators placed in said plurality of metal cavities, wherein said plurality of dielectric resonators comprise two opposing cylindrical TE mode resonators and two opposing rectangular HE mode resonators substantially adjacent to said two opposing cylindrical TE mode resonators; and one or more separating walls disposed between said plurality of dielectric resonators, wherein said one or more separating walls comprise a plurality of tunable irises for electromagnetic mixed coupling between said two opposing cylindrical TE mode resonators and said two opposing rectangular HE mode resonators.

6. The filter according to claim 5, wherein said plurality of tunable irises realize an electrical field coupling between said two opposing rectangular HE mode resonators.

7. The filter according to claim 5, wherein said two opposing rectangular HE mode resonators shifts the TE mode in frequency along with the undesired orthogonal HE mode.

8. The filter according to claim 5, wherein the rectangular shape of said two opposing rectangular HE mode resonators does not affect the frequency of the required HE mode and shifts the unwanted orthogonal HE mode.

* * * * *